US006688372B1

(12) United States Patent
Nien

(10) Patent No.: US 6,688,372 B1
(45) Date of Patent: Feb. 10, 2004

(54) VENETIAN BLIND HAVING THE OUTER APPEARANCE OF A SHUTTER

(75) Inventor: Ming Nien, Changhua (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/309,058

(22) Filed: Dec. 4, 2002

(30) Foreign Application Priority Data

Sep. 30, 2002 (TW) ..... 91215424 U

(51) Int. Cl.[7] ..... E06B 9/38
(52) U.S. Cl. ..... 160/172 R; 160/115
(58) Field of Search ..... 160/172 R, 168.1 R, 160/173 R, 176.1 R, 177 R, 178.1 R, 89, 107, 115, 113, 114

(56) References Cited

U.S. PATENT DOCUMENTS 4,456,049 A * 6/1984 Vecchiarelli ..... 160/176.1 R
5,226,466 A * 7/1993 Coddens ..... 160/107
6,098,698 A * 8/2000 King-Darr ..... 160/290.1
6,516,857 B1 * 2/2003 Gajtka et al. ..... 160/107

* cited by examiner

*Primary Examiner*—David Purol
(74) *Attorney, Agent, or Firm*—Bacon & Thomas, PLLC

(57) ABSTRACT

A Venetian blind having the shape of a shutter is constructed to include a fixed headrail shield by a top block at the top side of the window. Two side blocks are longitudinally located on two sides of the window. A bottom rail is suspended below the headrail. A set of slats is arranged in parallel between the headrail and the bottom rail. Two ladder tapes are connected in parallel at two sides between the headrail and the bottom rail and respectively linked to the ends of the slats suspended behind front shielding walls of the side blocks. A tilting control mechanism is formed of an operating rod and a tilt rod for driving the ladder tapes to control the tilting angle of the slats. A lift lock is adapted to lock the bottom rail at a desired elevation.

16 Claims, 4 Drawing Sheets

VENETIAN BLIND HAVING THE OUTER APPEARANCE OF A SHUTTER

BACKGROUND OF THE INVENTION

1. Field of the Invention

The present invention relates to blinds and, more specifically, to a Venetian blind having the outer appearance of a shutter.

2. Description of the Related Art

FIG. 1 shows a typical conventional shutter 90 made of solid wooden material or metal (normally, aluminum). The shutter 90 comprises a shutter frame 92, louvers 96 transversely arranged in parallel within the shutter frame 92 between the top and bottom blocks of the shutter frame 92 and respectively pivoted with the respective opposite ends to the two opposite side blocks of the shutter frames 92 at an equal pitch, and an operating rod 98 pivoted to each of the louvers 96 and vertically disposed at the front side of the shutter frame 92 on the middle. When the user pulled the operating rod 98 upwards or downwards, the louvers 96 are tilted between the open position and the close position. Because this design of shutter has a nice look, it decorates the window, making the room (house) beautiful. However, due to high manufacturing cost, many consumers are hesitating about buying a shutter when selecting a blind. Further, when regulating the view field through, the user can only move the operating rod 98 to tilt the louvers 96. Even when the louvers 96 maintained in horizontal, the louvers 96 and the operating rod 98 still block a certain part of the view field.

SUMMARY OF THE INVENTION

The present invention has been accomplished under the circumstances in view. It is the main object of the present invention to provide a Venetian blind, which has the outer appearance of a shutter.

It is another object of the present invention to provide a Venetian blind having the shape of a shutter, which decorates the window, making the room (house) beautiful.

It is still another object of the present invention to provide a Venetian blind having the appearance of a shutter, which is inexpensive to manufacture.

To achieve these objects of the present invention, the Venetian blind comprises a headrail, a bottom rail, a set of slats arranged between the headrail and the bottom rail, at least two ladder tapes connected between the headrail and the bottom rail and coupled to the slats, and a tilting control mechanism for controlling the tilting angle of the slats to regulate the light. The Venetian blind of the present invention further comprises two longitudinal side blocks each having a top end and a bottom end respectively extended to the elevations of top and bottom sides of a window and a longitudinally extended front shielding wall facing the inside of the room in which the window is formed and located in front of one of the ladder tapes to keep the ladder tapes from sight. The tilting control mechanism includes a tilt rod pivotally mounted inside the headrail for driving the ladder tapes to tilt the slats and an operation rod suspended between the side blocks and suspended from the headrail for twisting by the user to rotate the tilt rod. The Venetian blind further comprise a lift lock adapted to lock the bottom rail at a desired elevation.

DETAILED DESCRIPTION OF THE PREFERRED EMBODIMENT

Figure 1:
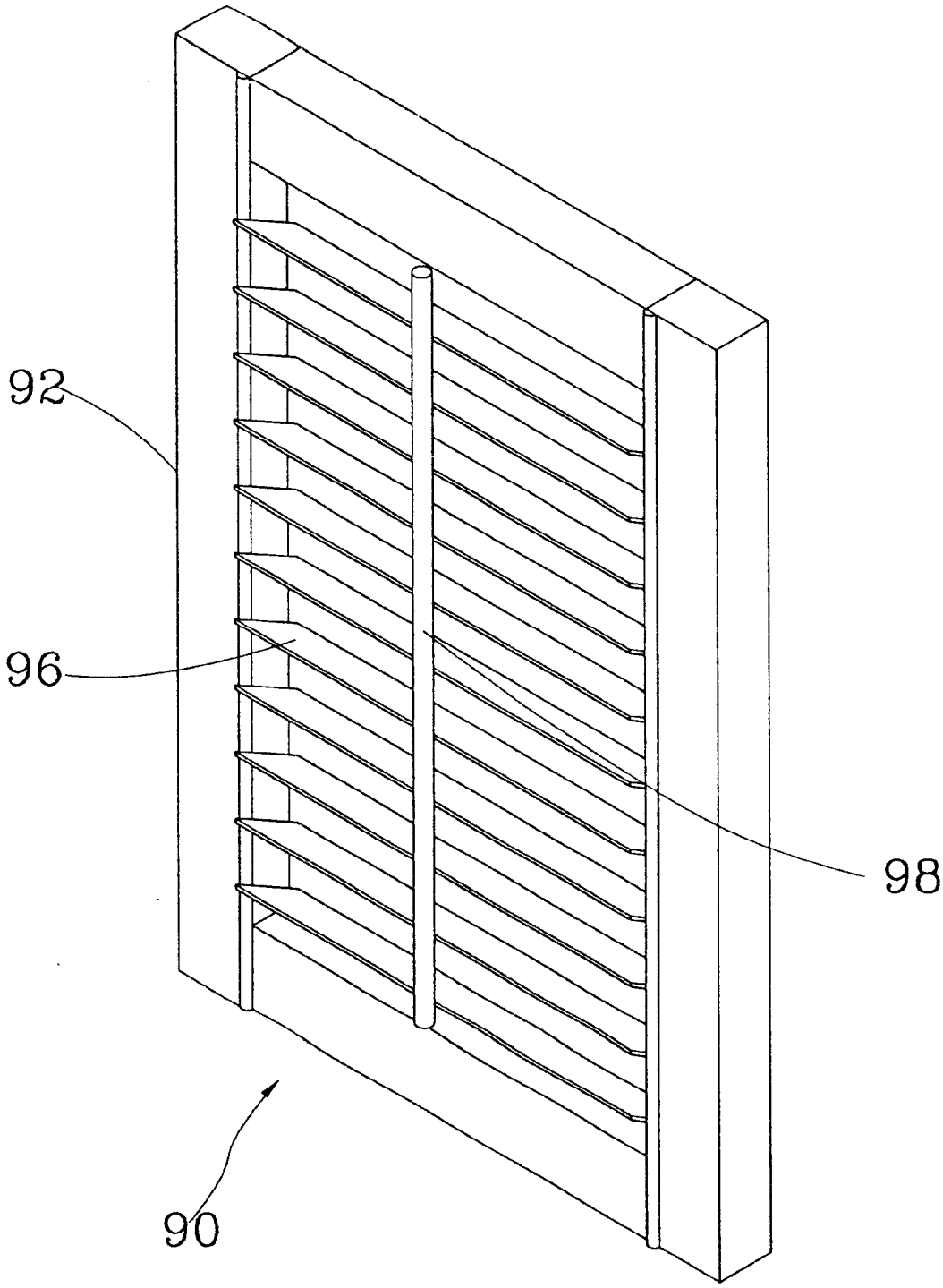
Fig. 1 PRIOR ART
FIG. 1 is a schematic view of a conventional shutter.
Figure 2:
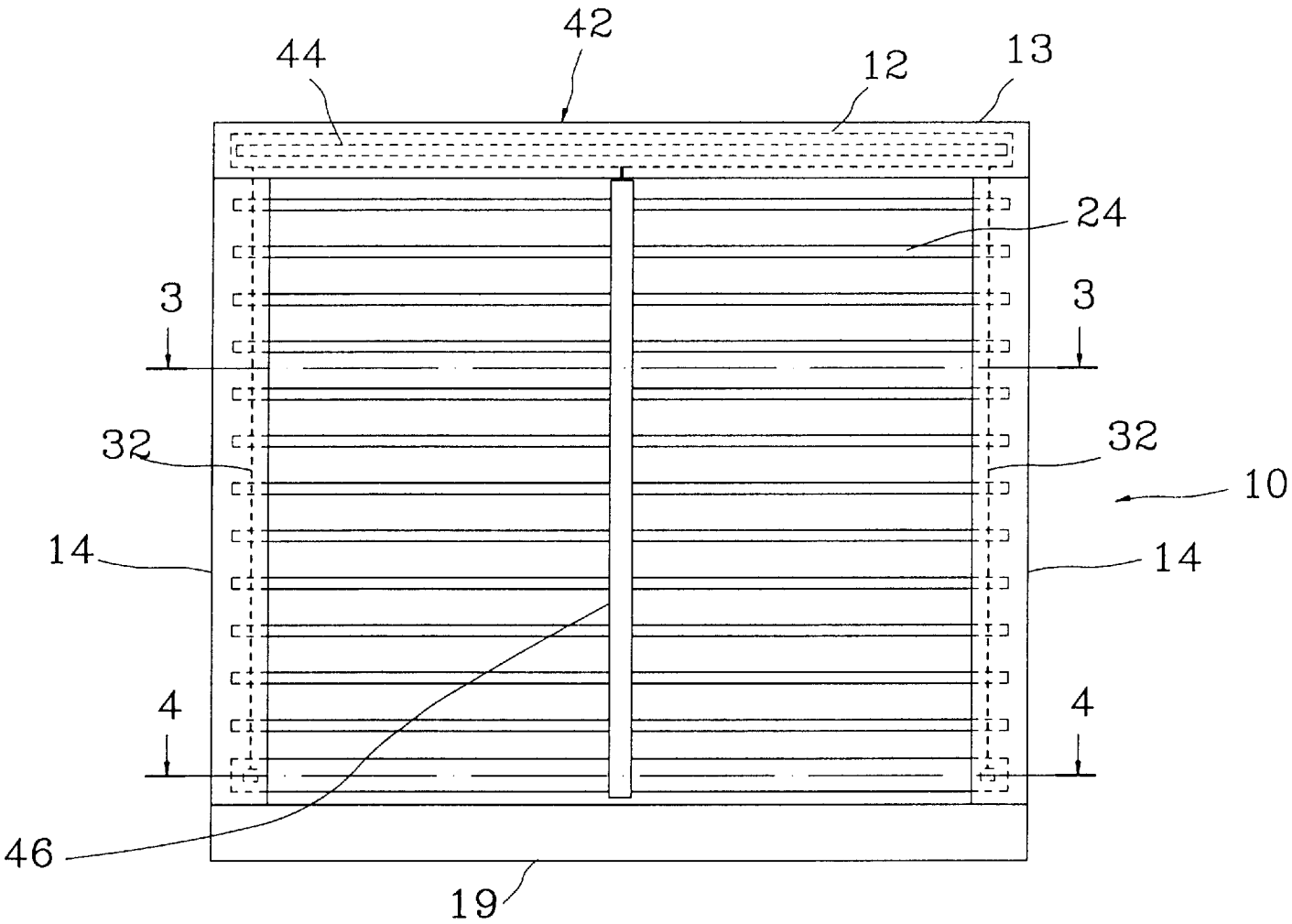
FIG. 2 is a schematic front view of a Venetian blind having the appearance of a shutter constructed according to the first preferred embodiment of the present invention.
Figure 3:
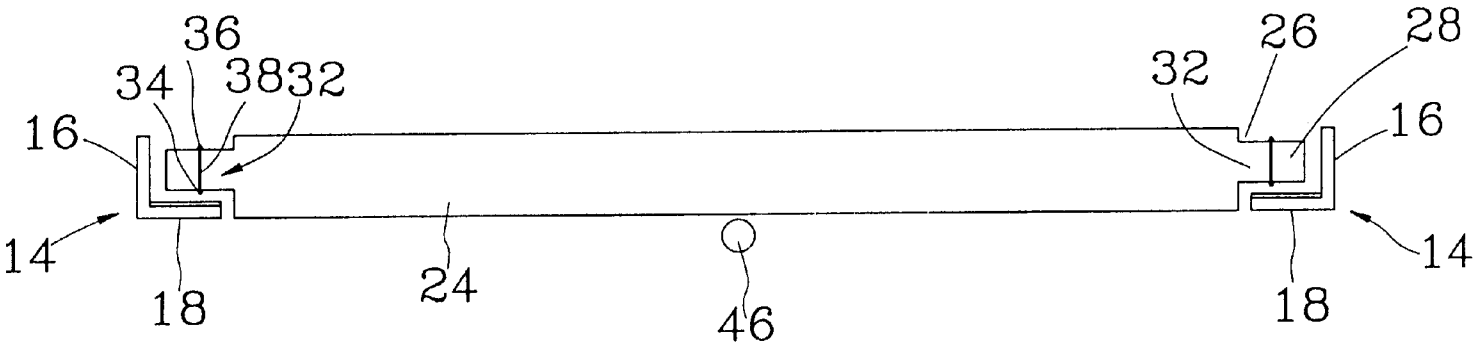
FIG. 3 is a sectional view taken along line 3—3 of FIG. 2.
Figure 4:
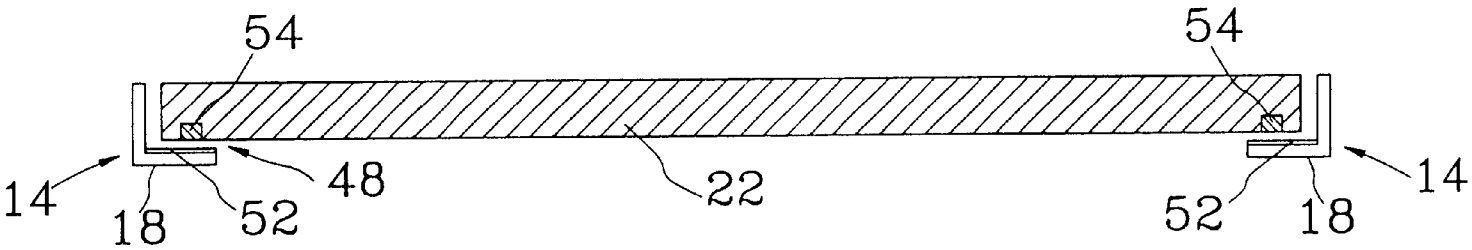
FIG. 4 is a sectional-view taken along line 4—4 of FIG. 2.

Referring to FIGS. 2~4, a Venetian blind 10 in accordance with the first preferred embodiment of the present invention is shown comprising a headrail 12, a transverse top block 13, two longitudinal side blocks 14, a transverse bottom block 19, a bottom rail 22, a set of slats 24, two ladder tapes 32, a tilting control mechanism 42, and a lift lock 48.

The headrail 12 is a tubular member slightly shorter than then transverse width of the window and fixedly provided at the top side of the window (according to this embodiment, the headrail 12 is fixedly fastened to the wall inside the house above the window; alternatively, the headrail 12 can be fixedly fastened to the top wall in the window).

The longitudinal side blocks 14 are fixedly provided at the left and side sides of the window. The length of the longitudinal side blocks 14 is approximately equal to the longitudinal length of the window. As shown in FIGS. 3 and 4, the side blocks 14 are shaped like an angle bar, each having a flat mounting wall 16 and a flat shielding wall 18 connected at right angles. The flat mounting wall 16 fixedly fastened to one lateral sidewall in the window, keeping the flat shielding wall 18 suspended at the front side of the window (if the headrail 12 is fixedly fastened to the top wall in the window, the flat shielding wall 18 shall be maintained in flush with the wall inside the house in which the window is formed).

The transverse top block 13 is fixedly provided at the top side of the window and connected between the top ends of the side blocks 14, keeping the headrail 12 from sight.

The transverse bottom block 19 is fixedly provided at the bottom side of the window and connected between the bottom ends of the side blocks 14.

The bottom rail 22 is shorter than the transverse width of the window and provided below the headrail 12 for vertical movement between the top block 13 and the bottom block 19. The two opposite ends of the bottom rail 22 are respectively suspended in the side blocks 14 behind the flat shielding walls 18 of the side blocks 14 (see FIG. 4).

The slats 24 are equal to the bottom rail 22 in length, and arranged in parallel between the headrail 12 and the bottom rail 22. As illustrated in FIG. 3, each slat 24 has end notches 26 symmetrically disposed at front and rear sides of the two distal ends thereof, forming two end protrusions 28 at the two distal ends. The end protrusions 28 of the slats 24 are respectively suspended behind the flat shielding walls 18 of the side blocks 14. When the slats 24 held in horizontal as shown in FIG. 3, the front edge of each slat 24 is maintained in flush with the front surfaces of the flat shielding walls 18 of the side blocks 14.

The ladder tapes 32 are longitudinally arranged in parallel to hold the slats 24 between the headrail 12 and the bottom rail 22. As illustrated in FIG. 3, the ladder tapes 32 are respectively fastened to the end protrusions 28 of the slats 24, and kept from sight by the flat shielding walls 18 of the side blocks 14. Each ladder tape 32 comprises a longitudinal front tape 34 and a longitudinal rear tape 36 longitudinally arranged in parallel at two sides of the end protrusions 28 of the slats 24, and a plurality of transverse connecting cords 38 respectively fastened to the end protrusions 28 of the slats 24 and connected between the longitudinal front tape 34 and the longitudinal rear tape 36.

The tilting control mechanism 42 is comprised of a transverse tilt rod 44 and an operating rod 46. The transverse tilt rod 44 is pivotally provided inside the headrail 12 for rotation on its own axis. The top ends of the longitudinal front tape 34 and longitudinal rear tape 36 of each of the ladder tapes 32 are respectively fixedly fastened to the front and back sides of the two distal ends of the tilt rod 44. When rotating the tilt rod 44, the longitudinal front tape 34 and longitudinal rear tape 36 of each ladder tape 32 are moved vertically relative to each other, thereby causing the slats 24 to be synchronously tilted. The operating rod is longitudinally disposed on the middle (equally spaced between the side blocks 14) in front of the slats 24, having a top end pivoted to the headrail 12. When twisting the operating rod 46, the tilt rod 44 is rotated to adjust the tilting angle of the slats 24. (Remark: because the transmission mechanism between the tilt rod 44 and the operating rod 46 and the transmission mechanism between the tilt rod 44 and the ladder tapes 32 are of the known art not within the scope of the claims of the present invention, no further detailed descriptions in this regard is necessary).

The lift lock 48 is adapted to lock the bottom rail 22 at the desired elevation. As illustrated in FIG. 4, the lift lock 48 comprises two elongated first magnetic elements 52 respectively longitudinally located on the back side of the flat shielding wall 18 of each of the side blocks 14, and two second magnetic elements 54 respectively located on the front side near the two distal ends of the bottom rail 22 corresponding to the first magnetic elements 52. When the bottom rail 22 pulled forwards, the first magnetic elements 52 attract the second magnetic elements 54 respectively, holding the bottom rail 22 in position. On the contrary, when pushed the bottom rail 22 backwards to disengage the second magnetic elements 54 from the first magnetic elements 52, the user can then adjust the elevation of the bottom rail 22. Alternatively, the side blocks 14 can be directly made of iron for securing the magnetic elements 54 at the ends of the bottom rail 22 by means of magnetic attraction. In this case, the first magnetic elements 52 are eliminated; or the bottom rail 22 can be made of iron for fastening to the magnetic elements 52 at the side blocks 14 by means of magnetic attraction. In this case, the magnetic elements 54 are eliminated.

Referring to FIG. 2 again, the Venetian blind 10 according to the first embodiment of the present invention has an outer appearance apparently different from conventional Venetian blind, i.e., the Venetian blind 10 having the outer appearance of a shutter. In comparison with conventional shutters, the Venetian blind 10 is less expensive and, highly acceptable to consumers. By means of the tilting control mechanism 42 and the lift lock 48, the user can conveniently adjust the tilting angle of the slats 24 and the elevation of the bottom rail 22 to regulate the light.

In the aforesaid first embodiment of the present invention, magnetic elements are used to lock the bottom rail at the desired elevation. Other lift lock structures may be selectively used. For example, the teaching of keeping spring force and article gravity in balance as disclosed in U.S. Pat. Nos. 6,012,506; 6,024,154; 6,029,734, may be employed to lock the bottom rail at the desired elevation. The lift lock design as shown in U.S. Pat. No. 6,044,889, issued to the present inventor, can also be used. According to this design, two positioning cord members are respectively extended from the headrail, and then inserted in parallel through the slats into the bottom rail, and then extended along the length of the bottom rail in reversed direction across each other to the outside of the ends of the bottom rail, and then respectively fastened to two vertical side rails outside the blind body. The invention eliminates the use of a lift cord. The use of a lift cord destroys the beauty of the shutter-like outer appearance of the Venetian blind, and may cause an accident when played by a child.

Figure 5:
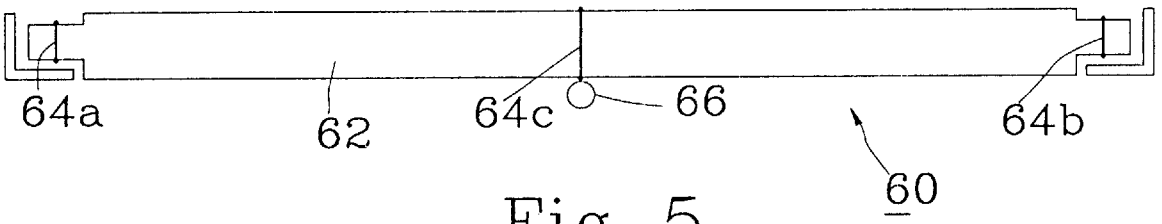
FIG. 5 is a sectional view in transverse direction of a Venetian blind having the appearance of a shutter constructed according to the second preferred embodiment of the present invention.

FIG. 5 is a sectional view of a Venetian blind 60 according to the second embodiment of the present invention (corresponding to FIG. 3 of the first embodiment of the present invention). According to this design, the slats 62 are relatively longer than the slats of the aforesaid first embodiment, and the two ladder tapes 64*a* and 64*b* may be insufficient to support the slats 62 in balance. In order to eliminate this drawback, a third ladder tape 64*c* is installed in the slats 62 on the middle between the first ladder tape 64*a* and the second ladder tape 64*b*. Because the third ladder tape 64*c* is disposed behind the operating rod 66, the operating rod 66 keeps the third ladder tape 64*c* from sight (if necessary, the operating rod 66 can be thickened, or the ladder tapes 64*a*–64*c* can be made of transparent belts or cord members.).

Figure 6:
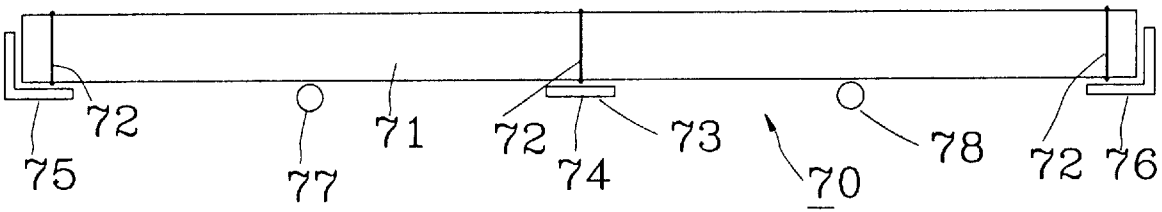
FIG. 6 is a sectional view in transverse direction of a Venetian blind having the appearance of a shutter constructed according to the third preferred embodiment of the present invention.

FIG. 6 is a sectional view of a Venetian blind 70 according to the third embodiment of the present invention. According to this design, three ladder tapes 72 are provided to join the slats 71; a flat middle block 73 is vertically connected between the top and bottom sides of the window on the middle in front of the slats 71, forming a shield 74 that keeps the middle ladder tape 72 from sight. According to this embodiment, the side blocks 75 and 76 are fixedly provided at the left and right sides of the window, and the flat middle block 73 separates the window into left and right halves. Further, two operating rods 77 and 78 are arranged in parallel and respectively spaced between the flat middle block 73 and the side blocks 75 and 76 on the middle for operation by hand to adjust the tilting angle of the slats 71 (the user can operate either of the operating rods 77 and 78 to adjust the tilting angle of the slats 71). Alternatively, two flat blocks may be vertically connected between the top and bottom sides of the window in front of the slats 71 to divide the window into three equal parts, and three operating rods may be respectively suspended in the three equal parts of the window to join the slats for operation by the user to adjust the tilting angle of the slats.

Figure 7:
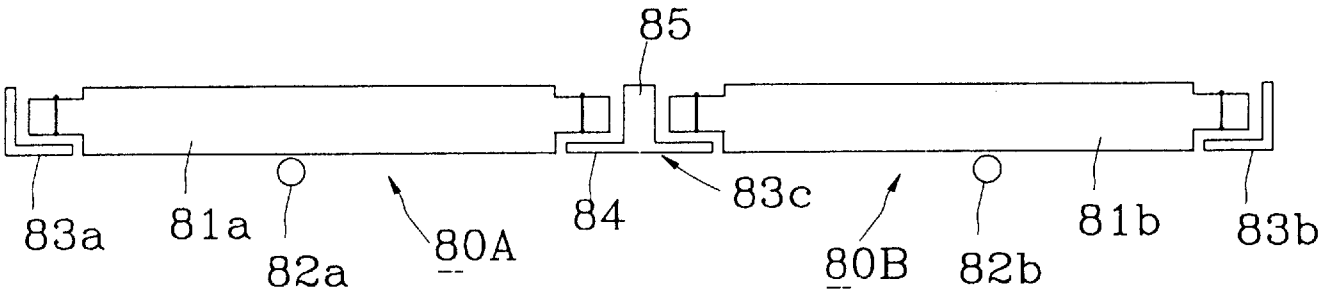
FIG. 7 is a sectional view in transverse direction of a Venetian blind having the appearance of a shutter constructed according to the fourth preferred embodiment of the present invention.

FIG. 7 is a sectional view of a Venetian blind 80 according to the third embodiment of the present invention. According to this design, two Venetian blinds 80A and 80B are arranged in parallel. The length of headrails (not shown), slats 81*a* and 81*b* and bottom rails (not shown) of the Venetian blinds 80A and 80B is about half of the transverse width of the window. The two Venetian blinds 80A and 80B are respectively arranged in the left and right halves of the window. The two Venetian blinds 80A and 80B each comprise a tilting control mechanism (having an operating rod 82*a* or 82*b*) and a lift lock. The user can adjust the tilting angle and elevation of the slats 81*a* and 81*b* of the two Venetian blinds 80A and 80B separately. The two Venetian blinds 80A and

80B are used with two side blocks 83*a* and 83*b* and a middle block 83*c*. Similar to the aforesaid embodiments, the side blocks 83A and 83*b* are shaped like an angle bar. The middle block 83*c* is an elongated bar of T-shaped cross section comprising a front flat shielding wall 84, which keeps the protruded right ends of the slats 81*a* of the first Venetian blind 80*a* and the protruded left ends of the slats 81*a* of the second Venetian blind 80*b* from sight, and a back partition wall 85 perpendicularly extended from the back side of the front flat shielding wall 84 to separate the slats 81*a* and 81*b* of the Venetian blinds 80*a* and 80*b*.

What the invention claimed is:

1. A Venetian blind installed in a window formed in the wall of a room for regulating the light, comprising:

at least two longitudinal blocks including two side blocks fixedly provided at two opposite lateral sides of said window, said longitudinal blocks each having a top end and a bottom end respectively extended to the elevations of top and bottom sides of said window and a longitudinally extended front shielding wall facing the inside of the room in which said window is formed;

a headrail transversely and fixedly fastened to the top side of said window between the top ends of said two side blocks;

a bottom rail transversely suspended below said headrail and vertically moveable relative to said headrail, said bottom rail having a length approximately equal to said headrail;

a plurality of slats arranged in parallel between said headrail and said bottom rail, said slats having a length approximately equal to said headrail and two opposite ends respectively suspended behind the front shielding walls of said two side blocks;

at least two ladder tapes longitudinally arranged in parallel to join said slats, said ladder tapes including a first ladder tape and a second latter tape longitudinally arranged in parallel at two sides and respectively connected to the ends of said slats behind the front shielding walls of said side blocks;

a tilting control mechanism having a tilt rod pivotally mounted inside said headrail for free rotation to drive said ladder tapes to tilt said slats, and at least one operating rod suspended between the next two longitudinal blocks and suspended from said headrail for twisting by the user to rotate said tilt rod, said at least one operating rod having a length approximately equal to the longitudinal length of said window; and a lift lock for locking said bottom rail at a desired elevation.

2. The Venetian blind as claimed in claim 1, wherein said operating rod is suspended between the next two longitudinal blocks about at a middle point between the next two longitudinal blocks.

3. The Venetian blind as claimed in claim 1, wherein the headrail has a length approximately equal to the transverse width of the window; the number of said longitudinal blocks is 2, which are the two side blocks respectively fixedly provided at the two opposite lateral sides of said window; the number of said ladder tapes is 2.

4. The Venetian blind as claimed in claim 1, wherein said headrail has a length approximately equal to the transverse width of said window; the number of said longitudinal blocks is 2, which are the two side blocks respectively fixedly provided at the two opposite lateral sides of said window; said ladder tapes include a third ladder tape equally spaced between said first ladder tape and said second ladder tape behind one of said at least one operating rod of said tilting control mechanism.

5. The Venetian blind as claimed in claim 1, said headrail has a length approximately equal to the transverse width of said window; said longitudinal blocks include said two side blocks respectively fixedly provided at the two opposite lateral sides of said window and a middle block equally spaced between said side blocks; said ladder tapes include a third ladder tape equally spaced between said first ladder tape and said second ladder tape behind said middle block.

6. The Venetian blind as claimed in claim 1, wherein said side blocks are shaped like an angle bar each having a flat mounting wall fixedly fastened to one lateral sidewall in said window, and said front shielding wall extended from said flat mounting wall at right angles suspended at a front side of said window.

7. The Venetian blind as claimed in claim 1, wherein 1, said bottom rail has two distal ends respectively suspended behind the front shielding walls of said side blocks.

8. The Venetian blind as claimed in claim 7, wherein said lift lock comprises two first magnetic elements longitudinally located on the front shielding walls of said side blocks at a back side facing the ends of said slats, and two second magnetic elements respectively located on the ends of said bottom rail for fastening to said first magnetic elements by magnetic attraction to hold said bottom rail at the desired elevation.

9. The Venetian blind as claimed in claim 1, wherein said slats each have two protrusions respectively extended from the ends thereof and suspended behind the front shielding walls of said side blocks.

10. The Venetian blind as claimed in claim 1, wherein said ladder tapes are made of transparent cord members.

11. The Venetian blind as claimed in claim 1 further comprising a top block and a bottom block respectively and fixedly fastened to the top and bottom sides of said window and connected between the top ends and bottom ends of said side blocks, said top block being located in front of the said headrail.

12. The Venetian blind as claimed in claim 1, wherein said headrail is fixedly fastened to the wall of the room in which said window is formed and disposed above said window; the front shielding walls of said side blocks protrude forwardly from the wall of the room in which said window is formed.

13. The Venetian blind as claimed in claim 1, wherein said headrail is fixedly mounted within said window at a top side; the front shielding walls of said side blocks are disposed in flush with the wall of the room in which said window is formed.

14. The Venetian blind as claimed in claim 1, wherein said headrail is fixedly mounted within said window at a top side; the front shielding walls of said side blocks protrude from the wall of the room in which said window is formed.

15. A Venetian blind installed in a window formed in the wall of a room for regulating the light, comprising:

two side blocks each having a top end and a bottom end respectively extended to the elevations of top and bottom sides of said window and a longitudinally extended front shielding wall facing the inside of the room in which said window is formed;

a middle block longitudinally connected between the top and bottom sides of said window and equally spaced between aid side blocks; and two blind units arranged in parallel between said side blocks and said middle block, said blind units each comprising a headrail transversely and fixedly fastened to the top side of said window between said middle block and one of said side block, a bottom rail transversely suspended below said headrail and vertically moveable relative to said headrail, said bottom rail having a length approximately equal to said headrail, a plurality of slats arranged in parallel between said headrail and said bottom rail, said slats having a length approximately equal to said headrail and two opposite ends respectively suspended behind the front shielding wall of one of said side blocks and a part of said middle block, at least two ladder tapes longitudinally arranged in parallel to join said slats, said ladder tapes including a first ladder tape and a second latter tape longitudinally arranged in parallel at two sides and respectively connected to the ends of said slats behind the front shielding wall of one of said side blocks and a part of said middle block, said ladder tapes each having a top end and a bottom end respectively fastened to said headrail and said bottom rail, a tilting control mechanism having a tilt rod pivotally mounted inside said headrail for free rotation to drive said ladder tapes to tilt said slats, an operating rod suspended between one of said side blocks and said middle block and suspended from said headrail for twisting by the user to rotate said tilt rod, said operating rod having a length approximately equal to the longitudinal length of said window, and a lift lock adapted to lock said bottom rail at a desired elevation.

16. The Venetian blind as claimed in claim 15, wherein said middle block is formed of an elongated bar of T-shaped cross section comprising a front flat shielding wall, which keeps one end of each slat of each of said blind units from right, and a back partition wall perpendicularly extended from a back side of the front flat shielding wall of said middle block to separate the slats of said two blind units.

* * * * *